US006432231B1

(12) United States Patent
Nielson et al.

(10) Patent No.: US 6,432,231 B1
(45) Date of Patent: Aug. 13, 2002

(54) EXTRUDABLE BLACK BODY DECOY FLARE COMPOSITIONS

(75) Inventors: Daniel B. Nielson; Dean M. Lester, both of Brigham City, UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/735,643

(22) Filed: Dec. 14, 2000

Related U.S. Application Data

(62) Division of application No. 09/311,298, filed on May 14, 1999, which is a continuation of application No. PCT/US97/19984, filed on Nov. 14, 1997.

(60) Provisional application No. 60/030,922, filed on Nov. 15, 1996.

(51) Int. Cl.[7] ..... C06B 45/10

(52) U.S. Cl. ..... 149/19.3

(58) Field of Search ..... 149/19.1, 116, 149/19.3; 102/336

(56) References Cited

U.S. PATENT DOCUMENTS

| | | | | |
|---|---|---|---|---|
| 3,474,732 A | | 10/1969 | Thomison | |
| 3,680,484 A | | 8/1972 | Stetter | |
| 3,744,418 A | | 7/1973 | Tyroler | |
| 4,094,711 A | | 6/1978 | Ramnarace | |
| 4,130,061 A | | 12/1978 | Boggs et al. | |
| 4,640,193 A | | 2/1987 | Koroscil | |
| 4,682,544 A | | 7/1987 | Koroscil et al. | |
| 4,860,657 A | | 8/1989 | Steinicke et al. | |
| 4,880,483 A | * | 11/1989 | Baldi | 149/6 |
| 5,456,455 A | | 10/1995 | Dillehay et al. | |
| 5,472,533 A | | 12/1995 | Herbage et al. | |
| 5,499,582 A | | 3/1996 | Schiessl et al. | |
| 5,531,163 A | | 7/1996 | Dillehay et al. | |
| 5,565,150 A | | 10/1996 | Dillehay et al. | |
| 5,585,594 A | * | 12/1996 | Pelham et al. | 102/336 |
| 5,587,552 A | | 12/1996 | Dillehay et al. | |
| 5,834,680 A | * | 11/1998 | Nielson et al. | 102/336 |
| 5,912,430 A | | 6/1999 | Nielson | |

FOREIGN PATENT DOCUMENTS

| | | |
|---|---|---|
| GB | 2 092 275 A | 8/1982 |
| GB | 2 266 944 A | 11/1993 |

* cited by examiner

*Primary Examiner*—Michael J. Carone
*Assistant Examiner*—Aileen J. Baker
(74) *Attorney, Agent, or Firm*—Sullivan Law Group

(57) ABSTRACT

An extrudable black body decoy flare composition which, when combusted, provided black body radiation is disclosed. The compositions generally include from about 40% to about 70% metal such as magnesium or aluminum, from about 10% to about 40% polytetrafluoroethylene, and from about 8% to about 30% binder. Important to the operation of the invention is the production of carbon upon combustion of the composition. Accordingly, polyaromatic thermoplastics, such as polystyrene and dimethyl phthalate, serve as the binder.

7 Claims, 1 Drawing Sheet

EXTRUDABLE BLACK BODY DECOY FLARE COMPOSITIONS

This appln is a Div. of Ser. No. 09/311,298 filed May 14, 1999 which is a con't of PCT/US97/19984 filed Nov. 14, 1997 and claims benefit of Prov. No. 60/030,922 filed Nov. 15, 1996.

FIELD OF THE INVENTION

The present invention is related to extrudable black body decoy flare compositions that dramatically improve processibility while maintaining the infrared radiation intensity of conventional decoy flare compositions. More particularly, the present invention is related to such compositions that are also capable of serving as a heat-seeking missile decoys for aircraft, tanks, and trucks.

BACKGROUND OF THE INVENTION

Aircraft-launched flares of various types have been used for many purposes. For example, it is often desirable to light a particular area at night. A flare may be used to produce light for search and rescue operations or for various military purposes. It is also well known to employ flares as a decoy tactic. That is, a flare may be used to cover the path of an aircraft through a particular area. One common situation is when the aircraft is encountering anti-aircraft fire. The use of a flare can distract the anti-aircraft fire sufficiently to allow the aircraft to proceed safely on its course.

Anti-aircraft missiles are commonly used in modern warfare. Such missiles may be launched from the ground or they may be launched from another aircraft. Many of this type of missile are designed to seek particular types of emissions characteristic of aircraft. Such emissions often take the form of heat and infrared light. Thus, "heat-seeking" missiles are often used against aircraft.

In this context, it is desirable to provide a flare that produces the type of emissions sought by the missile in older to distract the missile from the actual aircraft. Thus, flares that emit heat and infrared are well known and have been used for many years.

Conventional decoy flare materials have been a combination of magnesium and polytetrafluoroethylene (PTFE or "Teflon®") These compositions are known widely as magnesium-Teflon® flare compositions. These formulations produce a black body emission spectrum which has been used as a decoy for jet engines.

Current methods of producing magnesium-PTFE flare compositions require the use of solvents that are ozone-depleting or flammable. In one currently used method, the composition is produced by depositing the binder on the pyrotechnic mixture through solvent loss using, for example, acetone or methyl-ethyl ketone. The mixture is dried, after which it is consolidated through pressing or extrusion operations. In a second method, a binder such as Viton A®, which is a fluorinated ethylene propylene copolymer sold by DuPont, is deposited on the pyrotechnic mixture through polymer precipitation methods using hexane and acetone. The dried pyrotechnic powder is then consolidated through pressing or extrusion operations. This method requires large quantities of acetone and hexane, which are flammable, to carry the Viton A® binder. The solvents used in these methods have been the source of many fires during the processing of decoy mixes.

An additional problem with conventional magnesium-PTFE compositions is that they are very sensitive.

Moreover, such compositions require extensive operator exposure during mixer dumping, oven loading, and material break-up operations. Traditional methods have proven disadvantageous, as the processing and handling of conventional flare compositions is dangerous and has resulted in many injuries and even deaths. An additional problem with conventional magnesium-PTFE compositions is that such compositions typically require expensive ingredients such as specialty binders and spherical magnesium.

Accordingly, it would be a significant advancement in the art to provide compositions and methods of producing decoy flares that overcame the identified problems of producing conventional flares. In particular, it would be an advancement to provide flare compositions that eliminate the safety risks associated with handling unconsolidated pyrotechnic powder. It would also be an advancement in the art to provide flare compositions and methods of production that eliminate ozone-depleting or flammable solvent emissions that accompany production. It would be a further advancement in the art to provide such flare compositions that could be manufactured using traditional press/extrusion techniques or using a twin screw extruder.

It would also be an advancement to provide such compositions that exceed the radiometric performance of conventional magnesium-PTFE infrared decoy flare compositions. It would be a further advancement in the art to provide such compositions that cost less than conventional flare compositions to produce.

Such compositions and methods for producing decoy flares are disclosed and claimed herein.

SUMMARY AND OBJECTS OF THE INVENTION

The present invention is related to new compositions that produce black body radiation when ignited. A black body radiator is generally defined as a material that radiates over a broad spectrum, as described by the following equation:

$$M=\epsilon\sigma T^4 \ W\,cm^{-2}$$

where:

$\epsilon$=emissivity

T=absolute temperature $\sigma$=Stefan-Boltzmann constant

M=exitance

The novel extrudable black body decoy flare compositions defined herein function in a manner similar to conventional magnesium-PTFE infrared decoy flares: heat produced by the flare decoys the heat-seeking missile away from the target. The principle difference between a conventional magnesium-PTFE flare composition and this new flare composition is that the compositions of the present invention utilize polyaromatic thermoplastics rather than solvent deposition fluor-polymers (e.g., Viton A®) or poly-olefins as the binder component. The polyaromatic thermoplastic facilitates the processing of the flare material via extrusion without the use of solvents.

The primary reaction products of a conventional magnesium-PTFE flare are solid carbon and liquid magnesium fluoride. The high emissivities of these reaction products result in an efficient black body radiating plume. In contrast, the polyaromatic thermoplastic of the present invention pyrolyzes during flare combustion to produce carbon particles. This pyrolysis of the binder results in an efficient black body radiator in the exhaust plume.

The present invention relates to the use of polyaromatic thermoplastic compounds such as polystyrene and dimethyl phthalate as the binder in a black body decoy flare. The thermoplastic compounds enable a magnesium-PTFE flare composition to be extruded without the use of solvents. In addition, the aromatic rings are reduced to carbon in the fuel rich composition, producing an ideal incandescent species that augments the signature.

Pyrotechnic art teaches that the radiometric output of traditional flare formulations is directly tied to the binder content of the flare. Low binder levels (4%) produce the greatest radiometric output and high binder levels (8%) produce lower radiometric output. One traditional method for augmenting the radiometric output of a flare formulation when higher binder levels are required is to use a fluorocarbon (such as Viton A®) or high energy binder (e.g., a polyoxetane binder such as BAMO/AMMO). This increases the oxidative potential of the binder component. Therefore, it was unexpected that high polyaromatic binder (16%) content flares produced an increased output when compared to a standard maoncsium-PTFE flare.

Some of the primary benefits of the present invention are enhanced processibility, increased performance, elimination of solvents, and reduction in material and labor costs. Extrusion of flares containing polyaromatic thermoplastic binders increases processibility over traditional pressed flares by eliminating oven cure time, increasing processing line speed, decreasing labor costs, and significantly reducing the risk to operators from unconsolidated pyrotechnic exposure. The radiometric output of the flare is improved over traditional pressed magnesium-PTFE flares. The use of thermoplastic binders eliminates the need to use solvents to process the flare compositions. The solvents traditionally used are ozone-depleting or flammable. Elimination of solvents increases the environmental friendliness of the process and safety to operators. Polyaromatic thermoplastics are commonly used in the manufacture of a wide variety of products ranging from coffee cups to children's toys. These materials are far less expensive than halocarbons such as Viton A® or specialty binders commonly used in the manufacture of infrared flares.

Flares manufactured using compositions of the present invention are more easily demilitarized than flares manufactured using conventional compositions. Compositions utilizing polyaromatic thermoplastic binders may be removed from the flare casing by heating. This is to be contrasted with conventional flare materials which can be demilitarized only by complex and expensive mechanical or chemical processes.

These and other objects and advantages of the invention will become apparent upon reading the following detailed description and appended claims, and upon reference to the accompanying drawings.

DETAILED DESCRIPTION OF THE PREFERRED EMBODIMENTS

Figure 1:
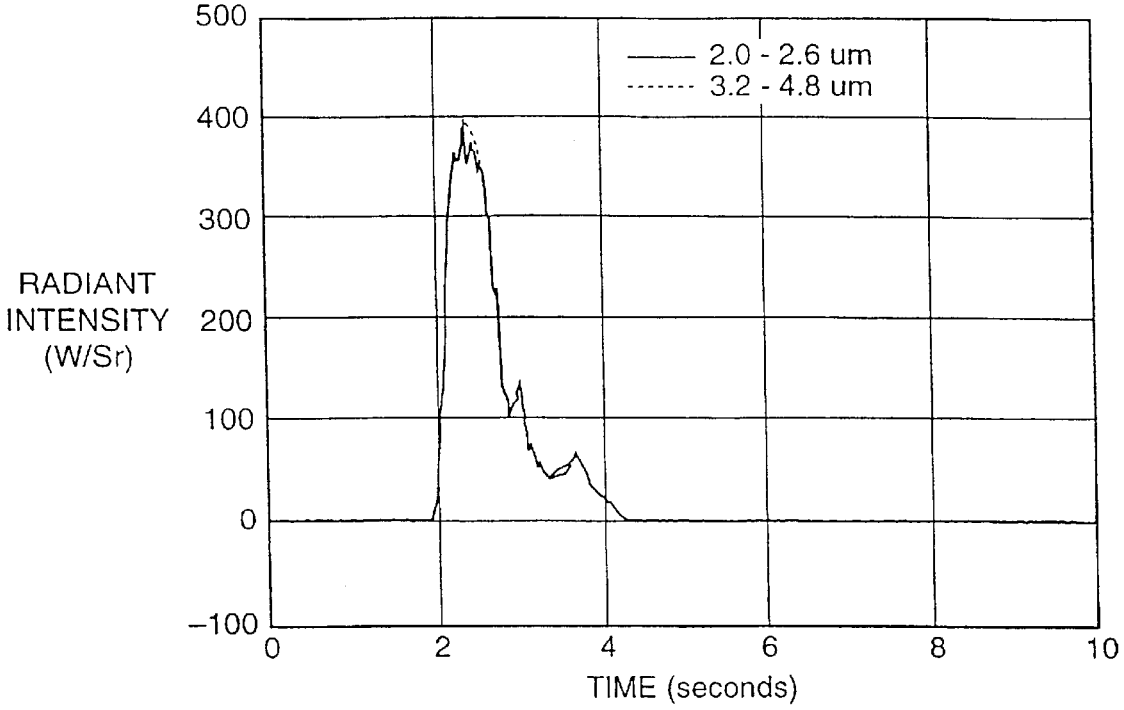
FIG. 1 is a graph illustrating the radiometric data generated by burning a pressed baseline magnesium-PTFE decoy flare composition.

The present invention provides improved extrudable black body decoy flare compositions and methods of use. The compositions are capable of producing significant amounts of black body radiation. At the same time, the compositions avoid some of the problems encountered with conventional flare compositions, including the handling of unconsolidated pyrotechnic powder and solvent emissions. Additionally, flares produced according to the method of the present invention cost less to produce than conventional flares.

Accordingly, the compositions of the present invention comprise a metal fuel, PTFE as the main oxidizer, and a polyaromatic thermoplastic binder. Other additives, including curing agents and burn rate modifiers, are used as is known in the art to tailor other characteristics of the composition. In summary, the present invention provides new and useful extrudable black body flare compositions.

A typical flare composition according to the present invention includes the following components in the following percentages by weight:

| Ingredient | Weight Percent |
|---|---|
| Magnesium | 40 to 70 |
| Teflon ® | 10 to 40 |
| Polyaromatic Thermoplastic Binder | 8 to 30 |
| Plasticizer | 0 to 24 |

Magnesium is the fuel of choice, although other metals, such as aluminum and mixtures of aluminum and magnesium, could also be used. Magnesium is easily ignited and has a strong capability to after-burn in the plume behind the flare. This after-burning is important to augment the infrared signature of the plume without increasing the combustion chamber's internal temperature. Magnesium used in the compositions of the present invention may be chipped, spherical, or a mixture of chipped and spherical. Chipped magnesium is less expensive than spherical magnesium.

It is presently preferred that the metal be in the range of from about 40% to about 70% by weight. Most formulations falling within the scope of the present invention will have metal in the range of from about 45% to about 65% by weight. Generally, good results have been obtained with formulations in which magnesium is present at from about 64% to about 66% by weight.

As in conventional magnesium-PTFE flare compositions, PTFE ("Teflon®") is the oxidizer in compositions of the present invention. It is presently preferred that PTFE be present in the range of from about 10% to about 40% by weight. Most formulations falling within the scope of the present invention will have PTFE in the range of from about 20% to about 35% by weight. Generally, good results have been obtained with formulations in which PTFE is present at about 25% by weight.

The flare formulations also include a polyaromatic thermoplastic binder. In certain presently preferred embodiments, the polyaromatic thermoplastic binder is comprised of polystyrene, which is commercially available, for example, from Amoco. Acrylonitrile butadiene styrenes (ABS) may be substituted for polystyrene. The polystyrene or ABS may be plasticized using phthalates, including dimethyl phthalate, diethyl phthalate, dibutyl phthalate, dioctyl phthalate, poly terephthalate, and poly ethyl terephthalate. Also usable are para or ortho substituted chloropolystyrenes, nitropolystyrenes, polyacenaphthalene, polyvinylcarbozol, polyvinylfluorene, other polyvinylaromatics, α methylpolystyrenes, α chloropolystyrenes, α alkylpolystyrenes, and copolymers of polystyrene, with, for example, butadiene acrylonitrile, and acrylic acid. In certain presently preferred embodiments, the polyaromatic thermoplastic is dimethyl phthalate-plasticized polystyrene.

The amount and content of the plasticizer may be varied to adjust the melting point of a flare composition. The melting point of the composition may be chosen to increase the ease of production or to meet the requirements of a specific tactical environment (e.g., a composition may be designed for long-term storage in a warm climate). Generally, the melting point of a composition decreases as the amount of plasticizer increases. Compositions with low melting points are easier to handle than compositions with higher melting points. However, compositions with low melting points do not maintain their mechanical properties as well as higher melting point compositions during high temperature (up to about 165° F.) storage. It is presently preferred that the plasticizer be present at up to about 80 weight percent of the polyaromatic thermoplastic binder. More particularly, the plasticizer is present at about 50 weight percent of the binder.

It is presently preferred that the polyaromatic thermoplastic binder be present at from about 8% to about 30% by weight. More particularly, the binder is present in the range of from about 10% to about 20% by weight. Generally, good results have been obtained with formulations in which the binder is present at about 14% to about 16% by weight.

The compositions of the present invention may also include conductive carbon fibrils, which reduce the composition's susceptibility to electrostatic discharge.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

| Ingredient | Weight Percent |
|---|---|
| Magnesium (spherical) | 66.0 |
| Teflon ® | 20.0 |
| Polystyrene | 7.0 |
| Dimethyl phthalate | 7.0 |

Figure 2:
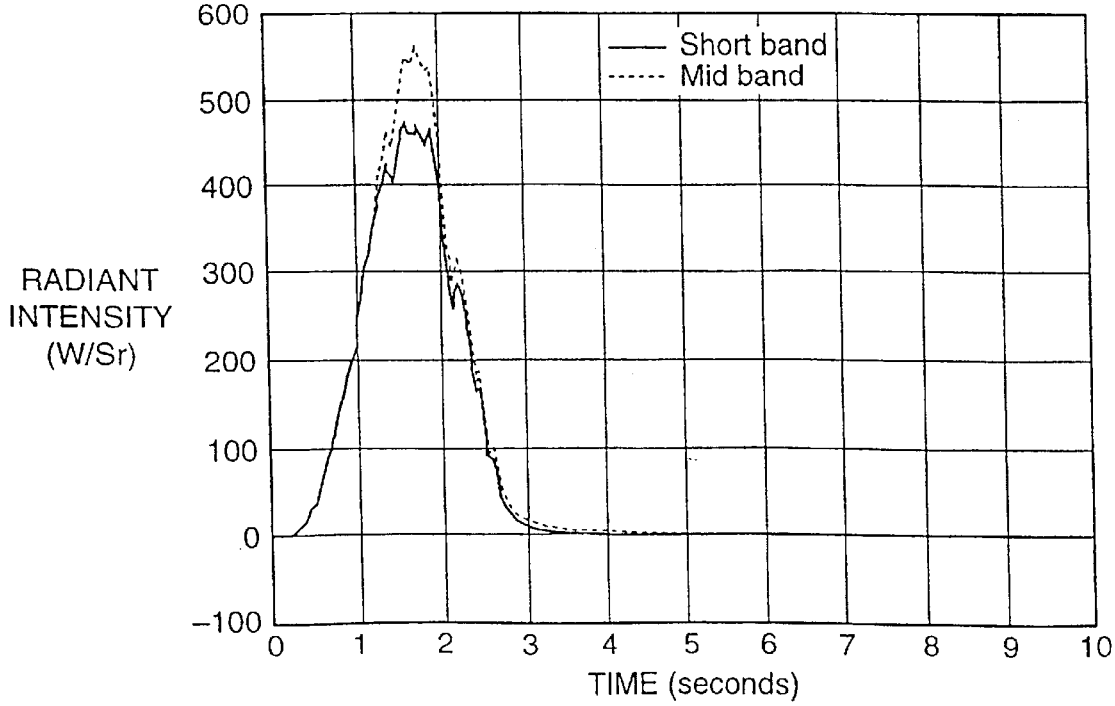
FIG. 2 is a graph illustrating the radiometric data generated by burning a composition within the scope of the present invention.

This composition exceeds the radiometric performance of fielded magnesium-PTFE decoy flares. FIG. 1 illustrates the radiometric data generated by burning a pressed baseline magnesium-PTFE decoy flare composition that is within the scope of the prior art. FIG. 2 illustrates the radiometric data generated by burning this composition. A comparison of these figures demonstrates that the radiometric output of this composition exceeds the radiometric output of the conventional composition.

Example 2

| Ingredient | Weight Percent |
|---|---|
| Magnesium (spherical or a 50–50 mixture of spherical and chipped) | 64.0 |
| Teflon ® | 20.0 |
| Polystyrene | 8.0 |
| Dimethyl phthalate | 8.0 |

This composition was extruded using a ram extruder, although this composition could also be extruded using a single or twin screw extruder.

SUMMARY

In summary, the present invention provides new and useful black body decoy compositions and methods of use. These compositions may be extruded without the use of solvents. Such compositions overcome some of the major drawbacks of decoy flare compositions. Thus, the flare compositions of the present invention represent a significant advancement in the art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An extrudable black body decoy flare composition comprising:

from about 40% to about 70% by weight magnesium;

from about 10% to about 40% by weight polytetrafluoroethylene; and from about 8% to about 30% by weight polyaromatic thermoplastic binder.

2. An extrudable black body decoy flare composition as defined in claim 1, wherein the polyaromatic thermoplastic binder comprises:

a styrene present from about 20 to about 100 weight percent of the binder, said styrene being polystyrene or acrylonitrile butadiene styrene; and a plasticizer present at up to about 80 weight percent of the binder, said plasticizer being selected from the group consisting of dimethyl phthalate, diethyl phthalate, dibutyl phthalate, dioctyl phthalate, poly terephthalate, poly ethyl terephthalate, para or ortho substituted chloropolystyrenes, nitropolystyrenes, polyacenaphthalene, polyvinylcarbozol, polyvinylfluorene α methylpolystyrenes, α chloropolystyrenes, α alkylpolystyrenes, copolymers of polystyrene, and mixtures thereof.

3. An extrudable black body decoy flare composition as defined in claim 1, wherein the composition is substantially free of fluorinated ethylene propylene copolymers.

4. An extrudable black body decoy flare composition as defined in claim 1, wherein the composition is substantially free of solvents.

5. A black body decoy, flare composition comprising:

from about 40% to about 70% by weight magnesium, from about 10% to about 40% by weight polytetrafluoroethylene; and from about 8% to about 30% by weight binder;

wherein the binder comprises polystyrene present from about 20 to about 100 weight percent of the binder and dimethyl phthalate present at up to 80 weight percent of the binder.

6. An extrudable black body decoy flare composition as defined in claim 5, wherein the composition is substantially free of fluorinated ethylene propylene copolymers.

7. An extrudable black body decoy flare composition as defined in claim 5, wherein the composition is substantially free of solvents.

* * * * *